United States Patent [19]

Taki et al.

[11] 3,933,081

[45] Jan. 20, 1976

[54] FLUID CONTROL CIRCUIT FOR A RADIO CONTROLLED VEHICLE

[75] Inventors: Hiroyuki Taki; Masanovu Ogura, both of Komatsu; Toru Tanabe; Hidenori Mizuguchi, both of Kanazawa, all of Japan

[73] Assignee: Kabushiki Kaisha Komatsu Seisakusho, Tokyo, Japan

[22] Filed: Apr. 17, 1974

[21] Appl. No.: 461,795

[52] U.S. Cl. ..... 91/411 R; 60/403; 60/484; 60/DIG. 2

[51] Int. Cl.[2] ..... F15B 11/16; F15B 13/06

[58] Field of Search ..... 60/400, 401, 403, 404, 60/405, DIG. 2, 484; 91/411 R

[56] References Cited

UNITED STATES PATENTS

| | | | |
|---|---|---|---|
| 2,403,391 | 7/1946 | Muir | 60/377 |
| 2,446,149 | 7/1948 | Wells | 91/411 R X |
| 2,643,515 | 6/1953 | Harsch | 60/DIG. 2 |

*Primary Examiner*—Edgar W. Geoghegan
*Attorney, Agent, or Firm*—Armstrong, Nikaido & Wegner

[57] ABSTRACT

A fluid control circuit for a radio controlled vehicle for operating an engine, transmission, steering, movable elements of earth-moving machines and braking device of the vehicle by means of radio control. The control circuit has plural shuttle valves interposed between brake cylinders and solenoid operated valves for controlling the brake cylinders. A circuit changing valve is interposed between a conduit communicating with the source of fluid under pressure and conduits communicating with operating cylinders for the engine, transmission, steering, earth-moving machines and braking devices through respective solenoid valves and the shuttle valves. Circuit changing valve is manually operable for selectively feeding fluid in pressure from the source thereof to either conduit communicating with the respective operating cylinders. Thus, the remote control of the vehicle can be simply changed to a manual one or vice versa by a single operation.

3 Claims, 4 Drawing Figures

FLUID CONTROL CIRCUIT FOR A RADIO CONTROLLED VEHICLE

BACKGROUND OF THE INVENTION

1. Field of the Invention:

This invention relates to a fluid control circuit for a radio controlled vehicle.

2. Description of the Prior Art:

Generally in a radio controlled vehicle, there is provided a remote controlling system by means of radio control and a manual controlling system for a driver on the vehicle. When control changes from the remote control to the manual control, the pneumatic or hydraulic circuit used for the remote control is transferred to a float operation and after brake cylinders or fluid cylinders for the respective operations operated by operating fluid under pressure upon radio control are released, they are manually operated.

However, heretofore, in a radio controlled vehicle of this type, such operation was inconvenient since several solenoid operated valves and manual cocks had to be switched every time manual operation was desired to transfer the pneumatic to hydraulic circuit to a condition permitting manual operation.

SUMMARY OF THE INVENTION

It is, therefore, an object of the present invention to provide a fluid controlled circuit for a radio controlled vehicle which may be simply transferred from remote controlling to manual or vice versa by a single operation.

One advantageous feature of the fluid controlled circuit of a radio control vehicle according to the present invention for operating an engine, transmission, steering, earth-moving machines, braking devices, etc., by means of radio control resides in the fact that shuttle valves are interposed between brake cylinders and solenoid controlled valves for controlling the brake cylinders. A conduit means communicates with the shuttle valves at respective inlet port sides thereof, and a circuit changing valve is interposed between a conduit means communicating with the source of fluid under pressure and conduit means communicating with operating cylinders for the engine, transmission, steering, earth-moving machines, braking devices, etc., through respective solenoid operated valves and the shuttle valves. The circuit changing valve is manually operable for selectively feeding fluid under pressure from the source thereof to either conduit communicating with the respective operating cylinders. A manual switching valve having a manual operating lever is connected to the circuit changing valve through a pilot circuit for actuating the circuit changing valve.

This and other objects, features and advantages of the hydraulic control circuit of the radio controlled vehicle according to the present invention will become more fully apparent from the following description taken in conjunction with the accompanying drawings.

DETAILED DESCRIPTION OF THE PREFERRED EMBODIMENTS

Figure 1:
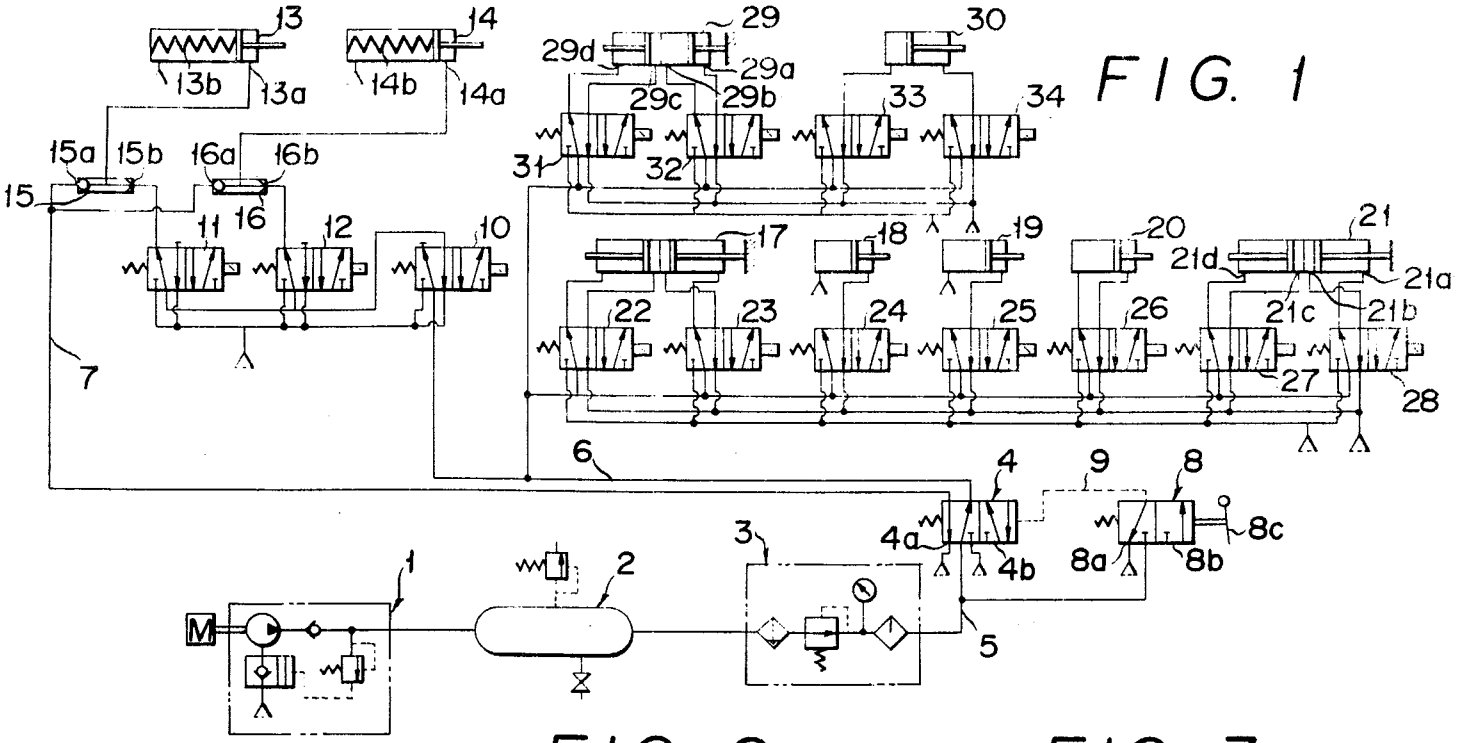
FIG. 1 is a fluid circuit diagram of the entire pneumatic control system of the radio controlled vehicle.

Referring now to FIG. 1, which shows one embodiment of the fluid control circuit of the radio controlled vehicle of the invention in a pneumatic control system, numeral 1 illustrates an air compressor, 2 an air tank, 3 an air pressure regulating device for setting the air pressure of the compressed air from the air compressor 1 and for mixing oil therewith. Numeral 4 indicates a circuit changing valve connected through a conduit 5 to the air pressure regulating device 3 and having transfer positions 4*a* and 4*b* for selectively feeding the compressed air from the conduit 5 to the conduits 6 and 7. Numeral 8 is a manually operable switching valve which has transfer positions 8*a* and 8*b* for communicating and connecting or disconnecting the conduit 5 and a pilot circuit 9 by a manual operating lever 8*c* mounted in a cab (not shown). This pilot circuit 9 communicates with the circuit changing valve 4 for switching the circuit changing valve 4 by the pilot pressure. Numeral 10 is a transferring solenoid operated valve for a parking brake device connected to the circuit changing valve 4 through the conduit 6 in a manner that when the vehicle is travelling, this solenoid operated valve is switched so that the brake is disengaged as shown in FIG. 1. Numerals 11 and 12 are transferring solenoid operated valves for right and left steering brake devices connected to the transferring solenoid operated valve 10 for the parking brake device, 13 and 14 are cylinders for operating right and left steering brake devices. These cylinders 13 and 14 for braking disengage the brake devices when the compressed air from the transferring solenoid operated valves 11 and 12 for braking is fed to the respective ports 13*a* and 14*a* and engage the brake devices when the compressed air is released from 13 and 14 by springs 13*b* and 14*b*. Elements 15 and 16 are shuttle valves interposed in the conduits between the transferring solenoid operated valves 11 and 12 for controlling the brake cylinders 13 and 14. The respective inlet ports 15*a* and 16*a* of the respective shuttle valves 15 and 16 are communicated through conduits 7 with the circuit changing valve 4, while other ports 15*b* and 16*b* are communicated with the transferring solenoid valves 11 and 12 for controlling the braking operation.

On the other hand, numeral 17 is a cylinder for adjusting fuel for the engine, 18 and 19 are cylinders for operating the right and left steering clutches, 20 and 21 are cylinders for operating the transmission to shift the transmission of a planetary gear hydraulic operating type device, and 22 to 28 are transferring solenoid operated valves for selectively feeding compressed air from the conduit 6 to the respective cylinders. Numerals 29 and 30 are cylinders for operating the moveable elements of the earth-moving machine, and 31 to 34 are transferring solenoid operated valves for selectively feeding the compressed air from the conduits 6. In the respective ports 21*a*, 21*b*, 21*c* and 21*d* of the cylinder 21 for operating the transmission, the compressed air is fed to the ports 21*a* and 21*d* in a neutral position of valves 27 and 28, to the ports 21*b* and 21*d* in a first speed position of said valves, to the ports 21*a* and 21*c* in a second speed position of said valves, and to the ports 21*b* and 21 *c* in a third speed position of said valves. In the respective ports 29*a*, 29*b*, 29*c* and 29*d* of the cylinders 29 for operating the movable elements of earth-moving machine, the compressed air is fed to the ports 29*a* and 29*c* for moving upwardly a movable element of the earth-moving machine, and to the ports 29*b* and 29*c* for permitting said movable element to float. The respective transferring solenoid operated valves are operated by the radio control in the remote control operation mode.

Figure 2:
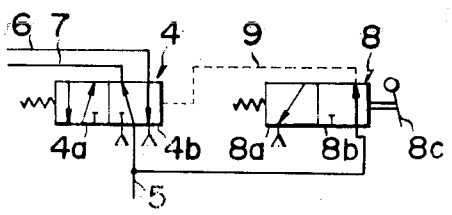
FIG. 2 is an explanatory view of the operation of an essential part of the fluid control circuit.

FIG. 1 shows the circuit diagram when the vehicle is parked in the state of radio control operation, and in order to transfer this state to a manual controlling operation, the manually operable switching valve 8 is moved to its FIG. 2 position, and pilot pressure is applied to the circuit changing valve 4 to move it to its FIG. 2 position. Thus, the circuit changing valve 4 is switched as shown in FIG. 2, and the compressed air from the conduit 5 is fed through the conduit 7 to the inlet ports 15*a* and 16*a* of the shuttle valves 15 and 16, respectively. The compressed air applied to brake cylinders 13 and 14 shuttle valves 15 and 16 releases the brakes. On the other hand, by moving the circuit changing valve 4 as above, the compressed air in the cylinders for operating the engine, steering, transmission, and further the movable element of the earth-moving machine, etc., is drained through the conduit 6, and these respective cylinders change to a floating state. Therefore respective operating elements operated by these operating cylinders upon the remote controlling operation become in free state so that the manual controlling operation can be applied at driver's option.

Figure 3:
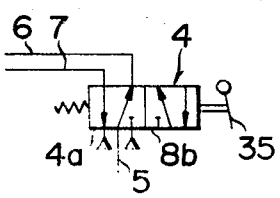
FIG. 3 is a fluid circuit diagram of another embodiment of an essential part of the radio controlled vehicle.

Through the circuit changing valve 4 interposed between the conduit 5 and the conduits 6, 7 is moved by the pilot pressure from the manually operable switching valve 8 in the above embodiment, as shown in FIG. 3, a manually operated lever 35 may be connected directly to the circuit changing valve 4 so as to directly operate the circuit changing valve 4.

Figure 4:
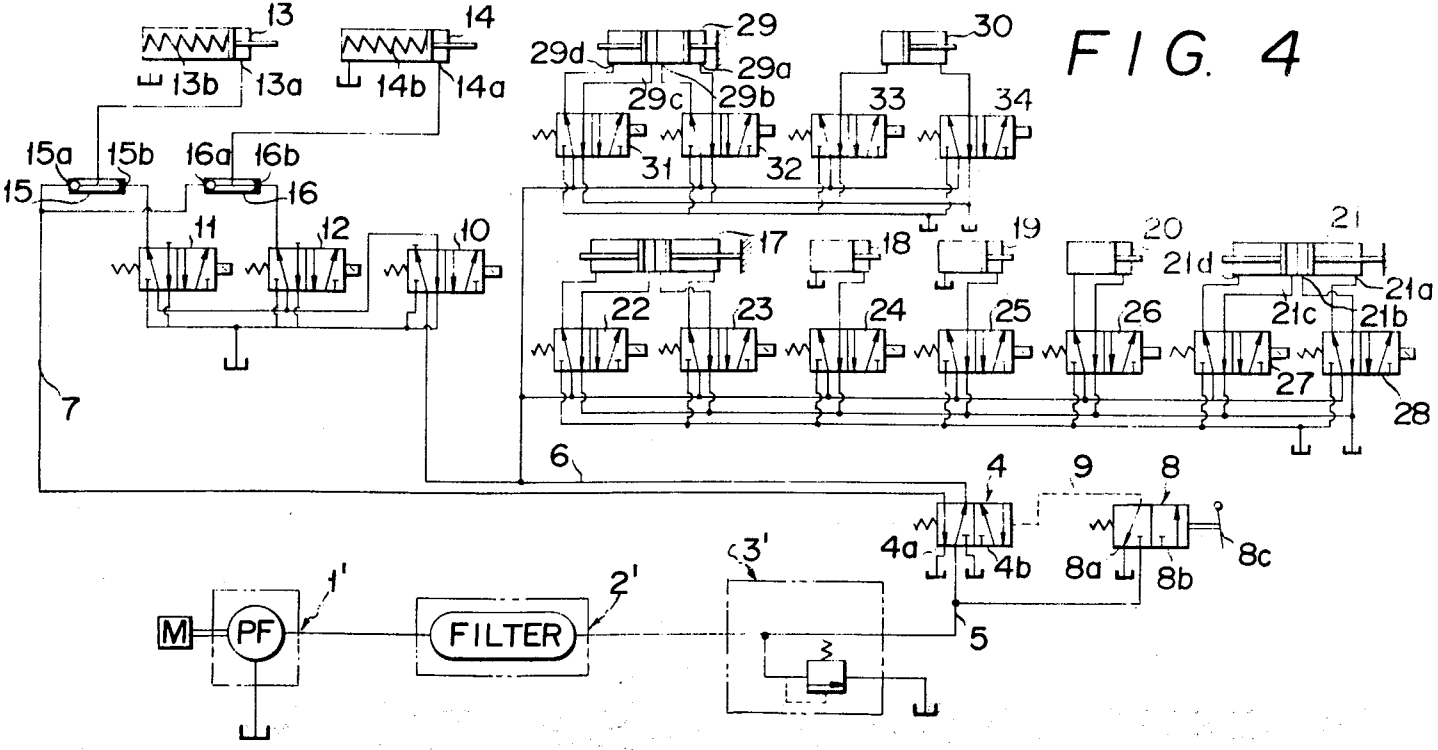
FIG. 4 is a fluid circuit diagram of the entire radio controlled vehicle hydraulic control system.

Further, when hydraulic pressure is used as the fluid pressure, the constitution of the circuit diagram may be as shown in FIG. 4, numeral 1' being a hydraulic pumping device, 2' an oil filter, 3' hydraulic pressure regulating device, and other reference numerals are common to those in the first embodiment shown in FIG. 1.

What is claimed is:

1. A fluid control circuit of a radio controlled vehicle for operating an engine, transmission, steering, movable elements of an earth-moving machine and braking devices of the vehicle by means of radio control, comprising a plurality of shuttle valves communicating at the output side thereof with a brake cylinder; a first conduit means communicating with said shuttle valves at respective inlet port sides thereof; a circuit changing valve means communicating with a source of fluid under pressure through a second conduit means, said circuit changing valve means being interposed between said second conduit means and said first conduit means communicating with said shuttle valves; and a third conduit means communicating with operating cylinders for the engine, transmission, steering, movable elements of an earth-moving machine and braking devices of the vehicle through respective remotely controlled solenoid operated valves for controlling said operating cylinders, said circuit changing valve means being manually operable between a first position for feeding fluid under pressure from said source to said first conduit means communicating with said shuttle valves and a second position for feeding fluid under pressure from said source to said third conduit means communicating with said operating cylinders through said solenoid operated valves, whereby said operating cylinders may be remotely controlled by the remote operation of said solenoid operated valves only when said circuit changing valve means is in said second position.

2. The fluid control circuit of claim 1, wherein said circuit changing valve means comprises a circuit changing valve; a pilot valve operatively coupled to said circuit changing valve; and a manually operated lever for controlling said pilot valve, whereby movement of said lever controls the movement of said circuit changing valve through said pilot valve.

3. The fluid control circuit of claim 1, wherein said circuit changing valve means comprises a circuit changing valve and a manually operated lever directly connected to said circuit changing valve, wherein movement of said lever moves said circuit changing valve.

* * * * *